United States Patent [19]

Clerigues

[11] 4,372,482

[45] Feb. 8, 1983

[54] INSTALLATION FOR SIGNALLING DEPOSIT OF MAIL IN A LETTER BOX

[76] Inventor: Jack J. V. Clerigues, 21, rue Bourdaloue, Nimes (Gard), France

[21] Appl. No.: 274,138

[22] Filed: Jun. 16, 1981

[30] Foreign Application Priority Data

Jun. 19, 1980 [FR] France ..... 80 13639

[51] Int. Cl.[3] ..... B65D 91/00

[52] U.S. Cl. ..... 232/36

[58] Field of Search ..... 232/36, 35, 37, 33

[56] References Cited

U.S. PATENT DOCUMENTS 935,934 10/1909 Sieh et al. ..... 232/36

1,442,578 1/1923 Landrum ..... 232/36

*Primary Examiner*—Gene Mancene

*Assistant Examiner*—James Hakomaki

*Attorney, Agent, or Firm*—Pollock, Vande Sande & Priddy

[57] ABSTRACT

This invention concerns an installation for signalling the deposit of mail in a letter box, the letter box comprising a movable shutter member in front of a mail insertion slot and an access door for removal of the mail deposited in the letter box.

6 Claims, 2 Drawing Figures

INSTALLATION FOR SIGNALLING DEPOSIT OF MAIL IN A LETTER BOX

The present invention concerns an installation for signalling the deposit of mail in a letter box.

The installation is provided with a letter box comprising a movable shutter member in front of a mail insertion slot, and an access door for removal of the mail deposited in the box, the installation being characterised in that the shutter member and the door are each connected to an electrical switch means arranged to be actuated respectively when the shutter member is raised and when the door is opened, the switch means associated with the door being disposed in the supply circuit of a relay having first and second switches, the first switch being disposed in a self-supply circuit and the second switch being disposed in series in the supply circuit of a signalling means.

In accordance with another feature of the invention, the relay which is disposed in a casing is connected to the switch means of the letter box by an electrical cable, the signalling means comprising two members which are disposed, in parallel, one on the casing and the other on the letter box.

In accordance with another feature of the invention, the second switch comprises a change-over switching switch, the two contact studs of which are connected to signalling means of different colours, which are provided on the casing.

In accordance with another feature of the invention, the letter box comprises a movable floor associated with a switch means, the switch means being disposed in the supply circuit of a signalling means provided on the casing.

The invention is illustrated by way of non-limiting example in the accompanying drawing in which.

Consequently, the aim of the present invention is to provide an installation of simple and uncomplicated construction, which permits signalling of the deposit of mail in a letter box, the signalling action being automatically stopped as soon as the mail is removed from the letter box.

Figure 2:
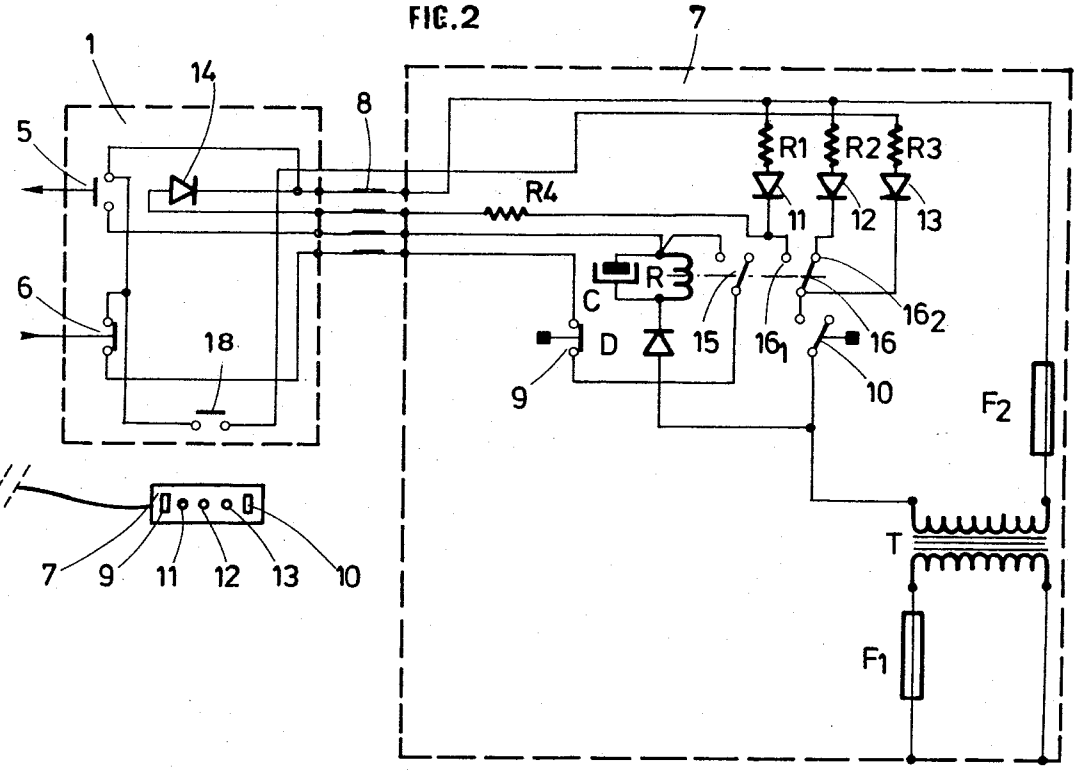
FIG. 2 shows the electrical circuit diagram of the installation of FIG. 1.
Figure 1:
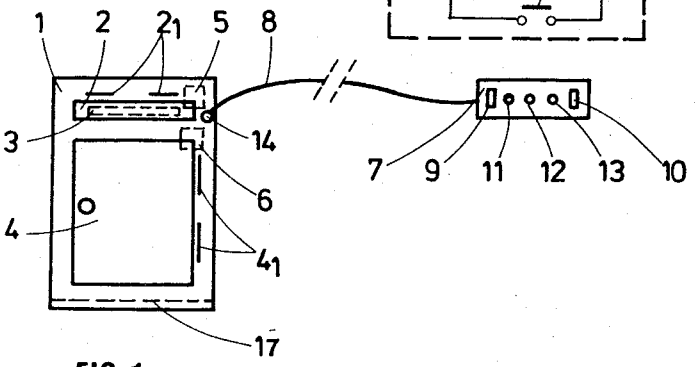
FIG. 1 is a diagrammatic view of the installation.

Thus, in the embodiment shown in FIG. 1, there is illustrated a letter box 1 which is provided with a shutter member 2 or flap, which is mounted pivotally by hinge means 2, 1 and which closes a slot 3 for introducing mail into the letter box.

The letter box is also provided with a door 4 which is mounted pivotally on hinge means 4, 1 and which is intended to permit removal from the letter box of the mail which has been previously deposited therein.

The shutter member or flap 2 and the door 4 are each associated with a respective switch means 5 and 6 which are respectively actuated when the shutter member 2 is raised to insert mail into the letter box, or when the door 4 is opened for removal of such mail.

The switch means of the letter box are connected to a casing 7 by way of a multi-conductor cable 8, the casing 7 comprising two manually operable switch means 9 and 10 and three light signals or tell-tables 11, 12 and 13 of different colours. Also provided on the front face of the letter box 1 is a light signal or tell-tale 14 which is intended to show that mail has been deposited.

Moreover, the letter box comprises a movable floor 17 associated with a switch means 18 for showing that a package or parcel has been deposited in the letter box.

For this purpose, the floor 17 is movable against the force of one or more return springs which are so calibrated as to permit actuation of the switch means 18 only when a parcel or package is deposited in the letter box, and not when a letter is deposited in the letter box.

The electrical circuit of this installation is supplied from the mains by way of a transformer T which produces an output voltage which is sufficiently low as not to be dangerous.

The supply circuit also comprises protective fuses F1 and F2.

The secondary winding of the transformer T is disposed in the supply circuit of a relay R which is disposed in series with a diode D and in parallel with a capacitor C.

The relay R is disposed in series with the switch means 5 associated with the shutter member or flap 2.

The relay R comprises two contacts or switches 15 and 16 of which one contact 15 is disposed in a self-supply circuit of the relay R in series with the manually operable switch means 9 on the casing 7, and the switch means 6 associated with the door 4 of the letter box.

The second contact 16 of the relay R is a changeover switching contact, the two contact studs of which are each connected to the signals 11 and 12.

In addition, the signal 11 of the casing 7 is disposed in parallel with the signal 14 on the letter box 1.

Finally, the signal 13 is supplied by a circuit including the switch means 18 of the floor of the letter box.

Preferably, the signalling means 11, 12, 13 and 14 will comprise light signals or tell-tales and for example light-emitting diodes associated with series resistors R1, R2, R3 and R4. However, if desired, the light signalling means could be replaced by sound signalling means.

The mode of operation of the above-described installation is as follows:

Voltage is applied to the arrangement by actuating the switch means 10, which causes the light signal 12 of the casing to light up.

This therefore shows that voltage has been applied.

When a piece of mail is deposited in the letter box, the shutter member 2 is either raised or pushed, which causes the switch means 5 to close and therefore supplies power to the relay R, the contacts 15 and 16 of which are switched over.

Closure of the contact 15 has the effect of providing self-supply for the relay R by way of the manual switch means 9 and the door switch means 6, which are both closed. The effect of the pivotal movement of the contact 16 is to interrupt the supply to the signal 12 which is for example green in colour and to apply voltage to the signal 11 which is for example red.

Likewise, the signal 14 which is disposed in parallel with the signal 11 has voltage applied thereto.

Thus, if the casing 7 is disposed within an apartment, the deposit of mail in the letter box will cause the signal 11 within the apartmemt and the signal 14 on the letter box to light up. The person to whom that mail is addressed thus being notified that the mail has been deposited in the letter box, that person can then take the mail from the letter box by opining the door 4, which will cause opening of the switch means 6 and therefore interrupt the self-supply to the relay R which returns to the rest position, thereby extinguishing the red signal or tell-tale 11 and lighting up the green signal or tell-tale 12.

If the person to whom the mail in the letter box is addressed does not wish to take possession of the mail immediately, it is possible to actuate the manual switch means 9, which also causes the self-supply to the relay R to be interrupted.

If a package or parcel is deposited in the letter box by way of the door 4, in that case, the weight of the package or parcel on the movable floor 17 actuates the switch means 18, the effect of which is to apply voltage to the signal 13 which is for example yellow in colour, in order to signal to the interior of the apartment that the package or parcel has been deposited in the letter box.

This signal 13 will remain lit until the person to whom the package or parcel is addressed has removed it from the letter box. In the embodiment illustrated, current is supplied by way of a transformer T which is disposed in the casing 7. However, when a plurality of signalling circuits are to be supplied with power from a single transformer, for example in the case of an apartment building comprising a plurality of apartments, the transformer for supplying power to all those circuits will preferably be disposed in the vicinity of the letter boxes. In that case, the connecting cable connecting each letter box to each casing will have to comprise an additional conductor.

I claim:

1. An installation for signalling the deposit of mail in a letter box (1), said letter box comprising a movable shutter member (2) in front of a mail insertion slot (3) and an access door (4) for removal of the deposited mail, characterised in that the shutter member and the door are each connected to an electrical switch means (5, 6) arranged to be actuated respectively when the shutter member is raised and when the door is opened, the switch means (6) associated with the door being disposed in the supply circuit of a relay having a first and a second switch, the first switch being disposed in a self-supply circuit of the relay in series with the switch means associated with the door, and the second switch being disposed in series in the supply circuit of a signalling means (11).

2. An installation according to claim 1 characterised in that the relay which is disposed in a casing is connected to the switch means of the letter box by an electrical cable, the signalling means comprising two members which are disposed in parallel, one on the casing and the other on the letter box.

3. An installation according to claim 1 characterised in that the second switch comprises a change-over switching switch, the two contact studs of which are connected to signalling means of different colours, which are provided on the casing.

4. An installation according to claim 1 characterised in that the letter box comprises a movable floor associated with a switch means, said switch means being disposed in the supply circuit of a signalling means provided on the casing.

5. An installation according to claim 1 characterised in that the casing comprises a manually operable switch means which is inserted, with the switch means associated with the door, in the self-supply circuit of the relay.

6. An installation according to claim 1 characterised in that the second switch of the relay is disposed in series with a manually operable switch means provided on the casing.

* * * * *